United States Patent [19]

de la Cruz et al.

[11] 4,320,680

[45] Mar. 23, 1982

[54] FRUIT CUTTER

[76] Inventors: Pantaleon S. de la Cruz, 8917 S. 84th Ct., Hickory Hills, Ill. 60457; Michel A. Chonez, 2838 Scott St., Des Plaines, Ill. 60018

[21] Appl. No.: 126,835

[22] Filed: Mar. 3, 1980

[51] Int. Cl.[3] ..... B26D 3/26

[52] U.S. Cl. ..... 83/870; 83/49; 83/411 R; 83/581

[58] Field of Search ..... 83/49, 870, 411 R, 581; 30/294, 124, 299, 315

[56] References Cited

U.S. PATENT DOCUMENTS

| | | | |
|---|---|---|---|
| 1,482,735 | 2/1924 | Catsules | 30/294 |
| 1,820,342 | 8/1931 | Boehmer | 83/411 R |
| 2,560,229 | 7/1951 | Leavens . | |
| 2,711,200 | 6/1955 | Johnson, Jr. | 83/870 X |
| 3,099,303 | 7/1963 | Anderson et al. | 83/411 R X |
| 3,138,186 | 6/1964 | Laudien | 83/411 R |
| 3,673,920 | 7/1972 | Wahlen et al. | 83/411 R |
| 3,948,124 | 4/1976 | Dombrowski et al. | 83/411 R X |

*Primary Examiner*—Frank T. Yost

*Attorney, Agent, or Firm*—McDougall, Hersh & Scott

[57] ABSTRACT

A cutting assembly, when mounted on a base, is used to cut a fruit or the like along a circular cross section to form two substantially equivalent sections having serrated edges. The cutting assembly comprises a rotatable cup that may be held in a fixed position by a marker. A knife supported by the cutting assembly is inserted into and withdrawn from the fruit. Repetition of the rotation of the cup and the insertion of the knife produces the serrated fruit sections.

11 Claims, 7 Drawing Figures

FIG. 4
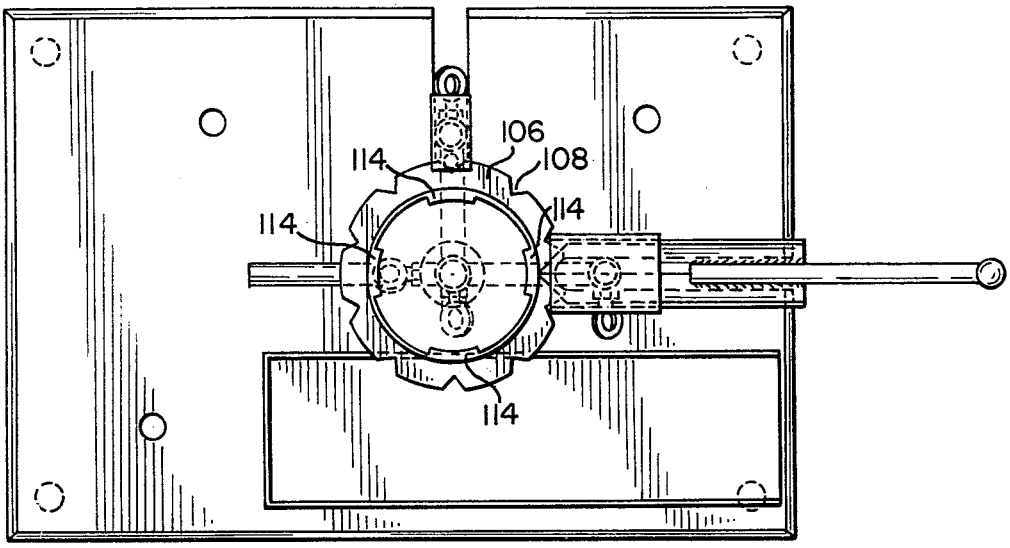
FIG. 6
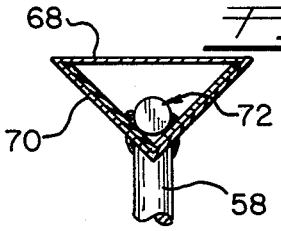
FIG. 7
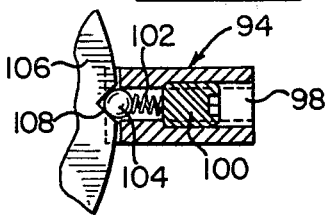
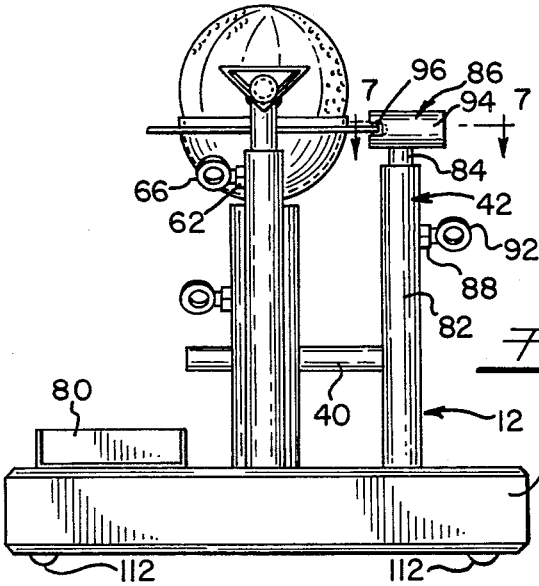
FIG. 5

FRUIT CUTTER

BACKGROUND OF THE INVENTION

The present invention relates generally to a device for slicing objects along a circular cross section and particularly, to a method and apparatus for uniformly cutting fruits and vegetables to form two substantially equivalent sections having serrated edges. The device can be used to split any object of curvilinear construction, but has particular applicability in the cutting of citrus fruits.

It is often desirable to sever fruit using a scalloped or serrated cut, rather than via a straight planer cut as can be accomplished with an ordinary knife. The restaurant industry, for example, has utilized serrated cut fruit sections for many years to embellish or decorate foods.

Fruit can be severed into two equivalent sections, each section having a decorative serrated edge, by use of a V-shaped knife blade. The proficient use of a hand-held knife to artistically cut fruit, however, requires a considerable degree of manual dexterity and experience.

Devices have been disclosed which include a component to guide the operator in the insertion of the knife blade and, thus, decrease the level of skill required of the operator. See, for example, U.S. Pat. No. 1,482,735. Such devices, however, are cumbersome and time-consuming to use, and may still require a high level of proficiency by the operator.

SUMMARY OF THE INVENTION

The invention is a method and apparatus for uniformly cutting a curvilinear object, such as a fruit or vegetable, in half so that each half has a serrated edge. The device comprises a base component and a cutting assembly which firmly holds the object to be cut in an upright position. The base of the device can be inexpensively manufactured from a material such as wood or plastic; the components of the cutting assembly are preferably made of metal.

The base includes a hole, which extends through the base, and a pair of slots, each of which extend transverse to the plane of the base. A center column held vertically within the hole is the principal support of the cutting assembly. A knife holder support and a marker rod support are received by the slots of the base to brace the assembly. In addition, cross members of the knife holder and marker rod supports are connected to the center column to further stabilize the device.

In the operation of the invention, a fruit or vegetable is placed in a cup which is mounted in the center column such that the cup is freely rotatable about a vertical axis. The upper portion of the cup may be slightly bent to more firmly hold the fruit during cutting. The cup includes a rim having a plurality of cutaway sections.

When the cup is rotated about the axis, the cutaway sections function as points which can be engaged by a marker assembly. More specifically, a spring driven detent ball within the marker extends into a given cutaway section to fix the position of the cup and fruit. The marker is supported by a rod which is received within the marker rod support.

After the cup is rotated and the detent ball locks the cup in position, a V-shaped knife blade sheathed and supported in the knife holder is inserted into the fruit. Upon withdrawal of the blade, the cup and fruit are again rotated and the insertion of the knife blade is repeated. By repetition of this procedure, the fruit is severed into the sections by a series of V-shaped cuts.

It is the principal object of this invention to provide a method and apparatus for cleanly cutting a fruit or vegetable into two substantially equivalent sections, each section having a decorative serrated edge. The device can easily be operated regardless of the manual dexterity or proficiency of the operator.

It is a further object of the invention to provide a device which can efficiently cut fruits and vegetables of virtually any size or shape. Adjustability is an important advantage in the use of the present invention.

In addition, it is an object of the invention to decrease the time required to decoratively cut a fruit or vegetable. This factor will assist the food preparation industry in reducing costs.

Other objects and advantages will be apparent from the following detailed description made with reference to the accompanying drawings.

BRIEF DESCRIPTION OF THE DRAWINGS

FIG. 4 is a top view taken along the line 4—4 of FIG. 3;

FIG. 5 is a side view taken along the line 5—5 of FIG. 3;

FIG. 6 is a sectional view taken along the line 6—6 of FIG. 3; and,

FIG. 7 is a sectional view taken along the line 7—7 of FIG. 5.

DETAILED DESCRIPTION OF THE INVENTION

Figure 1:
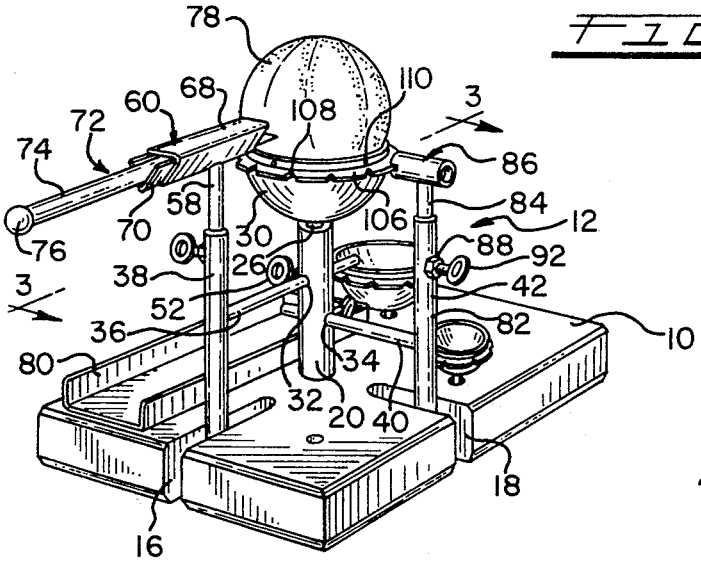
FIG. 1 is a perspective view of the device of the invention.
Figure 2:
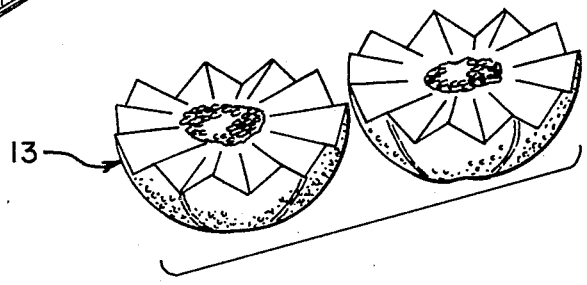
FIG. 2 is a perspective view of a melon severed through practice of the method of the invention.

FIG. 1 illustrates the device of the invention which comprises a base 10 and a cutting assembly generally designated by the numeral 12. Operation of the device produces a clean cut in fruits or vegetables; the severed half sections 13 are uniform in appearance as shown in FIG. 2.

The base 10 supports the assembly 12 by means of a bolt 14 which has a threaded shaft connected to column 20. The base also may define slots 16 and 18 which function in a manner to be described.

Figure 3:
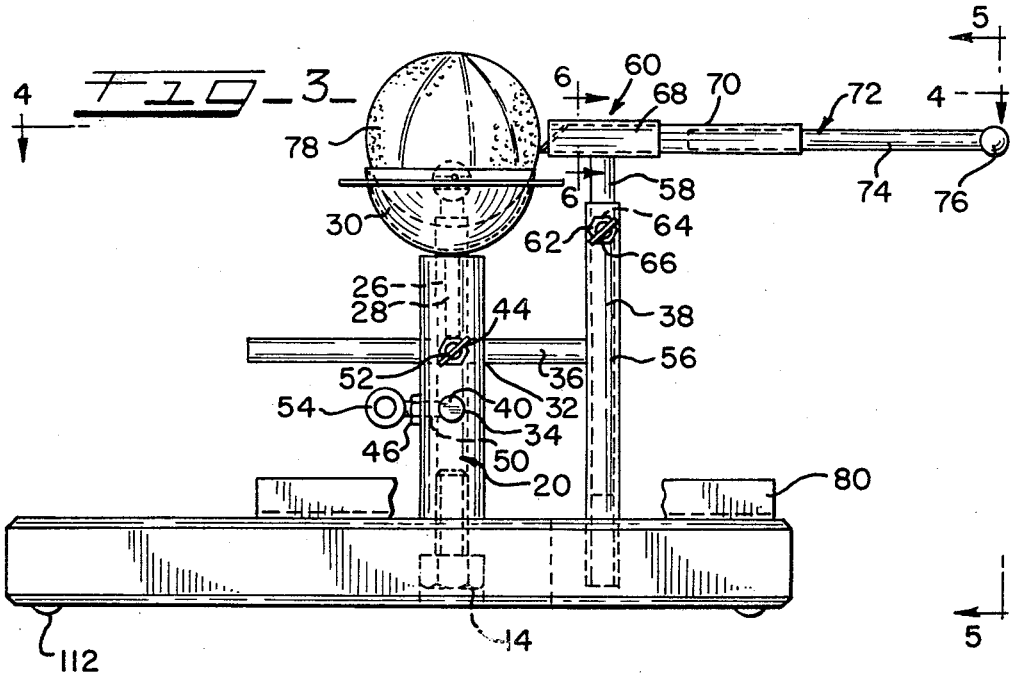
FIG. 3 is a front elevational view of the device taken along the line 3—3 of FIG. 1.

The principal support of the cutting assembly 12 is the center column 20 which is threaded into bolt 14 and is thus carried by the base 10. As further shown in FIG. 3, a hole 26 extends through the vertical axis of the center column 20. The hole 26 receives a post 28 which is connected to a cup 30 and permits the cup 30 to freely rotate in the hole 26 about the axis of the column 20.

Passages 32 and 34 extend through the center column 20 at right angles to the vertical axis. A cross member 36 of a knife holder support 38 can slide freely within the passage 32. Similarly, a cross member 40 of a marker support 42 slides freely through passage 34 of the center column 20.

Threaded nuts 44 and 46 may be secured to the side of the column 20 to connect with holes 48 and 50, respectively, which are in communication with passages 32 and 34. A threaded key 52 may be passed through threaded nut 44 and hole 48 to lock the cross member 36 of the knife holder support 38 in position. In a like manner, a threaded key 54 may be passed through threaded nut 46 and hole 50 to lock the cross member 40 of the marker support 42.

Alternatively, holes 48 and 50 may themselves be threaded to receive the proper threaded key. In addition, both cross members 36 and 40 may contain a flat section to permit the threaded keys 52 and 54, respectively, to more securely lock the cross members and thus, the knife holder and marker supports 38 and 42 in a fixed position during the cutting process.

The knife holder support 38 includes a tube 56, which is hollowed throughout its entire length, in addition to the cross member 36. The tube 56 is constructed to receive a rod 58 of a knife holder 60. The rod 58 can move freely within the tube 56 when not locked in position. The bottom of the tube 56 is braced within the slot 16 of the base 10. A threaded nut 62 may be secured to the side of the tube 56 to connect with a hole 64 which is in communication with the hollowed portion of the tube. A threaded key 66, similar to threaded keys 52 and 54, may be passed through threaded nut 62 and hole 64 to lock the rod 58 of the knife holder 60 in place. The rod 58 may contain a flat section to permit the threaded key 66 to firmly engage the rod.

Also comprising the knife holder 60 and connected to the rod 58 is a sheath 68 within which a V-shaped knife blade 70 of a knife 62 is supported, as best illustrated in FIGS. 4–6.

The sheath 68 may be a triangular cylinder adapted to receive a knife blade 70 having a width slightly less than that of a given cylinder side (see FIG. 6). The rod 58 is connected substantially perpendicular to the sheath 68 such that when the rod 58 is held upright within the tube 56, the sheath is parallel to the plane of the base 10. The knife blade 70 may thus be freely moved horizontally through the sheath 68.

The knife 72 comprises a handle 74 and the V-shaped blade 70. In the preferred embodiment of the invention, the handle 74 is a cylindrical rod which includes a rounded butt portion 76 to facilitate the gripping of the handle by the operator. If desired, the handle 74 may be threadably attached to the knife 70 whereby the handle could be interchangeably applied to the various blades.

A number of V-shaped knives, each with a different blade width, may be provided to vary the size of the cut in the fruit 78. Knife holders with sheathes adapted to accommodate the range of blade widths may also be provided. Selection of a knife with the proper blade width is necessary to insure a cut that is proportionate to the size of the fruit.

A tray 80 within which the knives may be stored when not in use may be secured to the base 10 by suitable adhesive. The tray 80 may be constructed of wood, plastic or metal. The tray 80 may also serve to store the knife holders. Alternatively, the series of knife holders may be stored in an upright position with the rod 58 of each holder mounted within a hole provided in the base 10.

The marker rod support 42 includes a tube 82, as illustrated in FIG. 5, in addition to the cross member 40 which is in communication with the column 20. The tube 82 is constructed to receive a rod 84 of a marker rod 86. The rod 84 can be freely moved within the tube 82 when not locked in place. The bottom of the tube 82 is braced within the slot 18 of the base 10.

In a manner similar to the previously described locking assemblies, a threaded nut 88 may be secured to the side of the tube 82 to connect with a hole 90 which is in communication with the interior portion of the tube. A threaded key 92 may be passed through threaded nut 88 and hole 90 to lock the rod 84 of the marker rod 86 in place. The rod 84 may also contain a flat section to permit the threaded key 92 to firmly engage the rod. The locking assemblies described enable the cutting assembly 12 to be easily adjusted to accommodate fruit of any size or shape.

Also comprising the marker rod 86 and connected at right angles to the rod 84 is a marker 94. As further shown in FIG. 5, the marker 94 includes a slot 96 at one end. A hole 98 extends through the marker 94; the hole may be partially threaded to receive a set screw 100 (see FIG. 7). A spring 102 within the hole 98 communicates a detent ball 104 with the set screw 100. The detent ball 104 is positioned within the junction of the hole 98 and the slot 96.

Referring to FIGS. 1 and 4, it will be noted that the cup 30 includes a rim 106 having a plurality of cutaway sections 108 which are substantially triangular in shape. Insertion of the post 28 within the hole 26 in the column 20 permits the cup 30 to be freely rotated about a vertical axis.

When the cup 30 is rotated on the column 20, the cutaway sections 108 function as points about the axis of rotation which can be engaged by the detent ball 104 of the marker 94. The coupling of the detent ball 104 with a given cutaway section fixes the position of the cup 30 prior to the cutting of the fruit 78.

In the operation of the invention, the fruit 78 or a similar curvilinear object is placed in the cup 30. Cups within a range of sizes may be provided to accommodate a variety of fruits. The cup 30 is rotated atop the column 20 until the detent ball 104 of the marker 94 engages a cutaway section 108 of the rim 106.

The rim 106 of the cup 30 may be served and bent at 90° intervals to provide gripping teeth 114. Presssing the fruit 8 against the teeth 114 of the cup maintains the fruit in a locked position until completion of the cutting operation.

Once the position of the cup 30 and fruit 78 is fixed, the V-shaped knife blade 70 is passed through the sheath 68 and into the fruit. It will, of course, be understood that the height of the knife holder 60 has been previously adjusted so that the fruit 78 is cut at mid-section.

The knife blade 70 is then withdrawn from the fruit 78 into the sheath 68 of the knife holder 60. As the knife blade 70 is inserted into the fruit, little juice is initially expelled, but when the knife blade 70 is withdrawn, a measurable quantity of juice may flow onto the rim 106 of the cup 30.

The rim 106 may be slanted to collect the juice. In addition, the section of the cup 30 in close proximity with the rim 106 may include a plurality of holes 110 which permit the juice to flow from the rim 106 into the cup 30 (see FIG. 1). In this manner, the possibility of the rim overflowing with excess juice is eliminated. This feature is especially useful when a series of fruits are to be rapidly cut into sections.

The interaction of the components of the cutting assembly 12 thus provides a rigid unitary structure to facilitate safe and efficient cutting. As an additional safety feature, the base 10 may include rubber stops 112 (see FIG. 3) to prevent the device from sliding during the cutting operation.

Slots 16 and 18 in the base 10 insure that the axes of support 38 and tube 82 are maintained vertically. If desired, the sides of the cross members 36 and 40 may be flattened for engagement by the keys 52 and 54 whereby the slots 16 and 18 may be eliminated.

It will be understood that various changes and modifications may be made in the above described apparatus and method without departing from the spirit thereof, particularly as defined in the following claims.

That which is claimed is:

1. An apparatus for cutting a substantially curvilinear object, said apparatus comprising:

(a) a base;

(b) a column carried by said base;

(c) a cup for holding the curvilinear object;

(d) means for supporting the cup on said column whereby said cup is freely rotatable;

(e) a knife for slidable insertion into said curvilinear object; and (f) means carried by said base for supporting said knife whereby the steps of inserting said knife into said curvilinear object, withdrawing the knife and rotating the cup before a new insertion divides the object in half along a horizontal plane to form two substantially equivalent sections.

2. An apparatus in accordance with claim 1 wherein said cup includes a rim having a plurality of cutaway sections and a marking means carried by said base, said marking means including a detent ball whereby said detent ball can engage a cutaway section to lock said cup in a fixed position.

3. An apparatus in accordance with claim 2 wherein said cup is removably supported on said column whereby cups of different sizes can be supported on the column, and including means adjustably supporting said marking means of said base whereby the detent ball of the marking means can be relocated to accommodate cups of different sizes.

4. An apparatus in accordance with claim 3 wherein said column extends vertically, said rim of said cup being located in a horizontal plane spaced vertically from said base, said means supporting said marking means being adjustable horizontally and vertically relative to said base.

5. An apparatus in accordance with claim 1 wherein said curvilinear object is a fruit.

6. An apparatus in accordance with claim 1 wherein the blade of said knife is V-shaped.

7. An apparatus in accordance with claim 6 wherein said knife defines a transverse dimension which is small relative to the circumference of the object so that several insertions of the knife and sequential rotations of the cup are required before the object is divided in half, each of said equivalent sections of the object thereby comprising a serrated section.

8. An apparatus in accordance with claim 1 wherein said means for supporting said knife comprises a tube, and including an operating handle connected to said knife and receivable within said tube, said handle providing means for reciprocating said knife relative to said tube and for thereby inserting and withdrawing said knife relative to said object.

9. An apparatus in accordance with claim 8 including adjustment means for said tube whereby the position of the tube relative to said object can be changed so that the knife can be inserted into the center of objects of different sizes.

10. An apparatus in accordance with claim 9 wherein said adjustment means for said tube permits horizontal and vertical adjustment of the tube relative to said base.

11. An apparatus in accordance with claim 1 including gripping means associated with said cup for maintaining the object in a locked position relative to the cup during the insertion and withdrawal of the knife.

* * * * *